US008256045B2

(12) United States Patent
Cruz

(10) Patent No.: US 8,256,045 B2
(45) Date of Patent: Sep. 4, 2012

(54) BLANKET BACKPACK

(76) Inventor: Ann Cruz, Mount Prospect, IL (US)

( * ) Notice: Subject to any disclaimer, the term of this patent is extended or adjusted under 35 U.S.C. 154(b) by 28 days.

(21) Appl. No.: 12/905,901

(22) Filed: Oct. 15, 2010

(65) Prior Publication Data

US 2011/0088165 A1 Apr. 21, 2011

Related U.S. Application Data

(60) Provisional application No. 61/253,749, filed on Oct. 21, 2009.

(51) Int. Cl.
*A47G 9/06* (2006.01)

(52) U.S. Cl. ..... 5/485; 5/417; 5/419; 383/4

(58) Field of Classification Search ..... 5/417, 419, 5/485, 656; 383/4
See application file for complete search history.

(56) References Cited

U.S. PATENT DOCUMENTS 3,483,575 A * 12/1969 McCarthy ..... 5/413 R
4,466,124 A 8/1984 Kirkham, Jr.
5,774,912 A * 7/1998 Dominique ..... 5/419
5,785,219 A * 7/1998 Kraft ..... 224/576
6,182,309 B1 * 2/2001 Sullivan ..... 5/419
6,243,892 B1 6/2001 Kelling
6,343,968 B1 2/2002 Louie et al.
6,393,638 B1 * 5/2002 MacColl ..... 5/419
6,421,852 B1 7/2002 Shao
6,543,072 B2 4/2003 Hsu
6,952,845 B1 * 10/2005 Akkad ..... 5/419
7,017,206 B1 * 3/2006 Kedineoglu ..... 5/417
7,058,997 B1 * 6/2006 Klinger ..... 5/413 R
2006/0037139 A1 2/2006 Akkad
2008/0216237 A1 9/2008 Tatsuno

* cited by examiner

*Primary Examiner* — Michael Trettel
(74) *Attorney, Agent, or Firm* — Cardinal Law Group

(57) ABSTRACT

Embodiments of the invention relate to a child sleeping system comprising a blanket, a pillow, pillow band and a carrying pouch. The blanket has a generally rectangular configuration and a length and a width. The pillow has a generally rectangular configuration filled with a non-allergenic material, and has a length and width, at least one of the pillow length and width in a predetermined dimensional relationship with at least one of the blanket length and width. The carrying pouch has a generally rectangular configuration, defines an opening at the first edge and communicates with the blanket second edge; the carrying pouch has a length and width in a predetermined dimensional relationship with at least one of the pillow length and width. The carrying pouch is adapted to receive the blanket and pillow when the pillow is folded over and the blanket side edges are folded over the pillow.

18 Claims, 7 Drawing Sheets

BLANKET BACKPACK

This application claims priority from U.S. Provisional Application Ser. No. 61/253,749 filed Oct. 21, 2009, the complete subject matter of which is incorporated herein by reference in its entirety.

FIELD OF THE INVENTION

The invention relates to a blanket or wrap. More particularly, embodiments relate to a blanket or wrap and pillow that fold into a carrying pouch, forming a tote or backpack having one or more adjustable straps for carrying, increasing the convenience and comfort of children at day care centers/preschools or other locations wherein rest might be desired.

BACKGROUND OF THE INVENTION

Blankets or mats which include their own storage system are known. However these known blankets are made of separate pieces, which tend to increase the bulk and weight of the device in its carrying configuration. Additionally, particularly with respect to inventions directed to children, using separate pieces increases the probability of a component being misplaced by the child user.

Therefore, there exists a need for a blanket or wrap and pillow that folds into a carrying pouch, forming a carrycase or backpack having one or more adjustable straps for carrying, which can be used for increasing the convenience and comfort of children. In this regard, the present invention substantially fulfills this need.

SUMMARY OF THE INVENTION

One embodiment relates to a child sleeping system with a blanket, a pillow, a pillow band and a carrying pouch. The blanket has a generally rectangular configuration and comprises first and second surface and first, second and two opposing side edges, the blanket further having a length and a width. The pillow band has a generally rectangular configuration and comprises first and second surface, and first, second and two opposing side edges. The pillow band first edge communicates with the blanket first edge, the pillow band having a length and width, at least one of the pillow length and width in a predetermined dimensional relationship with at least one of the blanket length and width. The pillow has a generally rectangular configuration and comprises at least two rectangular portions and first, second and two opposing side edges. The pillow is coupled together at least one of the first, second and two opposing edges and filled with a non-allergenic material. The pillow first edge communicated with the pillow band second edge, the pillow having a length and width, at least one of the pillow band length and width in a predetermined dimensional relationship with at least one of the pillow band length and width. The carrying pouch has a generally rectangular configuration and comprises at least two rectangular portions and first, second and two opposing side edges. The carrying pouch is coupled at the second and two opposing edges defining an opening at the first edge, and communicates with the blanket second edge. The carrying pouch has a length and width, at least one of the carrying pouch length and width in a predetermined dimensional relationship with at least one of the pillow length and width. The carrying pouch is adapted to receive the blanket and pillow when the pillow is folded over using the pillow band so that one of the pillow two rectangular portions contacts one of the blankets first and second surfaces and the blanket side edges are folded over the pillow, and blanket enfolding the pillow folded over and into the carrying pouch through the opening at the first end.

In at least one embodiment, the pillow band length and width is about one inch greater than the blanket length and width respectively; the pillow length and width being width is about one third the blanket length and width respectively; and the carrying pouch length and width being at least one inch greater than the pillow length and width respectively.

Other embodiments comprise the opening of the carrying pouch is reclosable using releasable fasteners. The carrying pouch further includes a pair of adjustable carrying straps coupled to the carrying pouch. Each of the pair of adjustable carrying straps includes strap adjusters coupled to at least one end of the carrying straps. Releasable fasteners securing the straps to the carrying pouch. The system further including releasable fasteners along at least one of the two opposing blanket side edges, at least one of the blanket side edges being positionable over another blanket side and closed using the resealable fasteners.

Yet another embodiment relates to a child sleeping system with a blanket having a generally rectangular configuration, a pillow band, a pillow and a carrying pouch. The blanket includes a first and second surface and first, second and two opposing side edges, the blanket having a length and a width. The pillow band has a generally rectangular configuration and includes first, second and two opposing side edges, the pillow band first edge communicating with the blanket first edge, the pillow band has a length and width about one third the blanket length and width respectively. The pillow has a generally rectangular configuration and includes at least two rectangular portions and first, second and two opposing side edges, the pillow coupled together at least one of the first, second and two opposing edges and filled with a non-allergenic material, the pillow first edge communicating with the pillow band second edge, the pillow having a length and width about one inch greater than the pillow band length and width respectively. The carrying pouch has a generally rectangular configuration and includes at least two rectangular portions and first, second and two opposing side edges, the carrying pouch coupled at the second and two opposing edge defining an opening at the first edge, the carrying pouch communicating with the blanket second edge, the carrying pouch having a length and width, the carrying pouch length and width being about one inch greater than the pillow length and width respectively, the carrying pouch adapted to receive the blanket and pillow when the pillow is folded over using the pillow band so that one of the pillow two rectangular portions contacts one of the blankets first and second surfaces and the blanket side edges are folded over the pillow, and blanket enfolding the pillow folded over and into the carrying pouch through the opening at the first end.

Still another embodiment relates to a child sleeping system with a blanket having a generally rectangular configuration, a pillow band, a pillow and a carrying pouch. The blanket includes a first and second surface and first, second and two opposing side edges, the blanket having a length and a width and releasable fasteners along at least one of the two opposing blanket side edges, at least one of the blanket side edges being positionable over another blanket side and closed using the resealable fasteners. The pillow band has a generally rectangular configuration and comprising first, second and two opposing side edges, the pillow band first edge communicating with the blanket first edge, the pillow band having a length and width, at least one of the pillow band length and width in a predetermined dimensional relationship with at least one of the blanket length and width. The pillow has a generally rectangular configuration and comprising at least two rectangular portions and first, second and two opposing side edges, the pillow coupled together at least one of the first, second and two opposing edges and filled with a non-allergenic material, the pillow first edge communicating with the pillow band second edge, the pillow having a length and width, at least one of the pillow length and width in a predetermined dimensional relationship with at least one of the pillow band length and width. The carrying pouch having a generally rectangular configuration and comprising at least two rectangular portions and first, second and two opposing side edges, the carrying pouch coupled at the second and two opposing edge defining an opening at the first edge, the opening having releasable fasteners, the carrying pouch communicating with the blanket second edge, the carrying pouch having a length and width, at least one of the carrying pouch length and width in a predetermined dimensional relationship with at least one of the pillow length and width, the carrying pouch adapted to receive the blanket and pillow when the pillow is folded over using the pillow band so that one of the pillow two rectangular portions contacts one of the blankets first and second surfaces and the blanket side edges are folded over the pillow, and blanket enfolding the pillow folded over and into the carrying pouch through the opening at the first end; and a pair of adjustable carrying straps coupled to the carrying pouch using releasable fasteners, each of the pair of adjustable carrying straps includes strap adjusters coupled to at least one end of the carrying straps.

The foregoing and other features and advantages of the invention will become further apparent from the following detailed description of the presently preferred embodiment, read in conjunction with the accompanying drawings. The drawings are not to scale. The detailed description and drawings are merely illustrative of the invention rather than limiting, the scope of the invention being defined by the appended claims and equivalents thereof.

BRIEF DESCRIPTION OF THE DRAWINGS

Throughout the various figures, like reference numbers refer to like elements.

DETAILED DESCRIPTION OF PRESENTLY PREFERRED EMBODIMENTS

Figure 1:
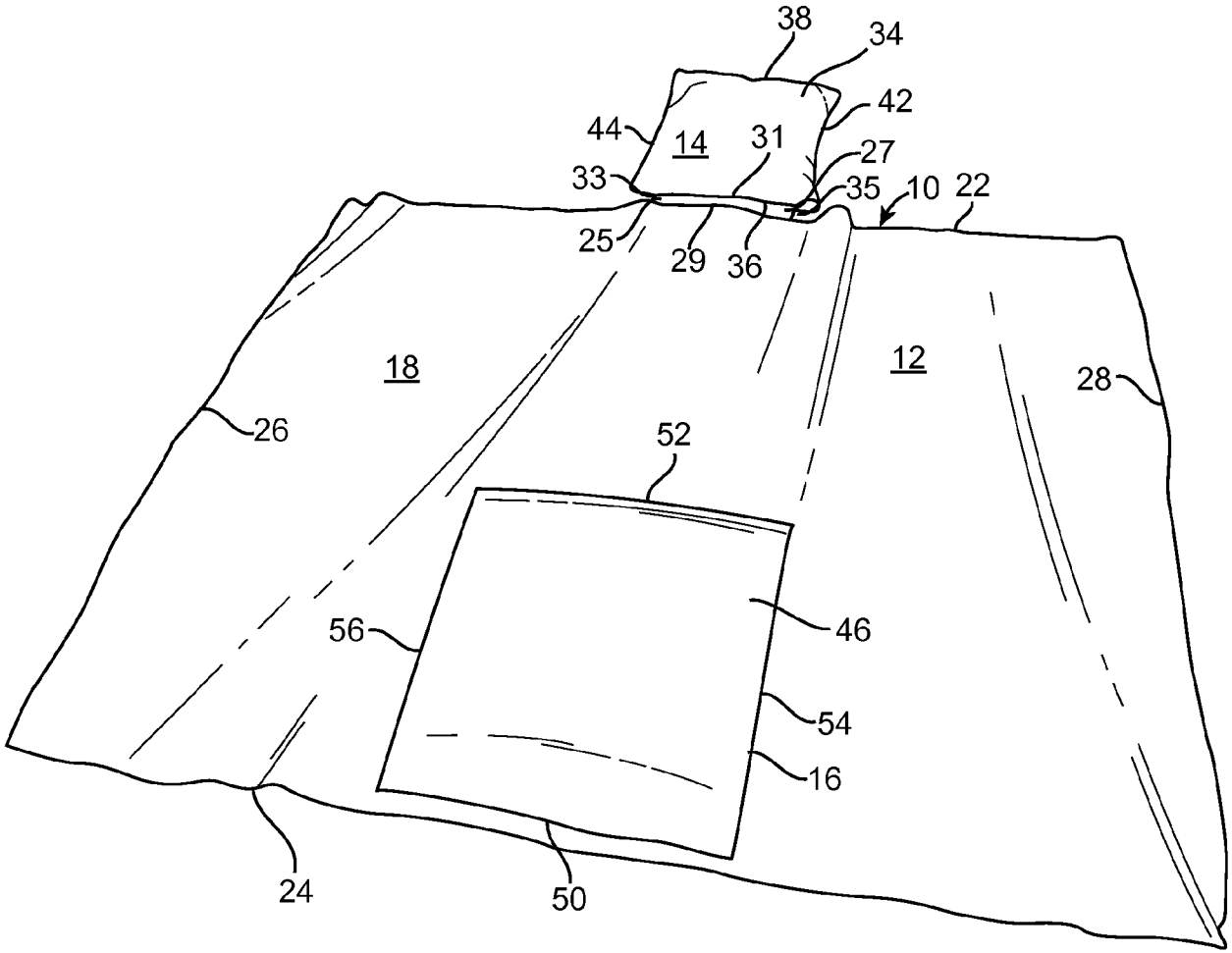
FIG. 1 depicts a top view of the wrap system including the blanket, pillow and carrying pouch in accordance with one embodiment of the present invention.

FIGS. 1-5 depict a child sleeping or wrap system generally designated 10 in accordance with one embodiment. In the illustrated embodiment, the wrap system 10 comprises a blanket 12, a pillow 14, a pillow band 25 and carrying pouch 16. Such components are individually configured and correlated with respect to each other so as to attain the desired objective.

As used herein, the word "wrap" refers to a sheet of fabric of a size and of a material suitable for use as a blanket, bath towel, or similar article. It should be appreciated that the material of the entire system or at least one portion thereof is preferably fabricated of a flame-retardant or flame-resistant material, although other materials, natural or synthetic or blends thereof could readily be utilized (polar fleece, cotton, wool, velour, nylon and the like for example). It should further be appreciated that the blanket 12, pillow 14, pillow band 25 and carrying pouch 16 may all be made of the same or different materials. Further, two or more elements of the system 10 may be made of one material, and the remaining elements comprised of a different material. Additionally, the dimensions as described herein are suitable for various sized users (different sized children for example), such that the relationships between the lengths and widths of the pillow, pillow band, blanket and carrying pouch are sized to accommodate the various sized users, while enabling the pillow, pillow band and blanket to be easily folded, received in the carrying pouch, and easily carried by the various sized users (different sized children for example).

The blanket 12 is in a generally rectangular or square configuration. The blanket 12 in one embodiment has a length of about 50 inches and a width of about 62 inches. Blanket 12 has first surface 18 and second surface 20 (best viewed in FIG. 3), a first edge 22, a second edge 24 and two opposing side edges 26 and 28.

In at least one embodiment, the system 10 may include releasable fasteners along at least one of the two opposing blanket side edges 26 and 28, where at least one of the blanket side edges 26, 28 is positionable over another blanket side edge using the resealable fasteners (Velcro® hook and loop fasteners, snaps, buttons and loops, and the like).

The system 10 further comprises a pillow band 25 in a generally rectangular or square configuration. The pillow band 25 in one embodiment has a length of about 11 inches and a width of about 3 inches. Pillow band 25 has a first surface 27 and second surface (not shown), a first edge 29, a second edge 31 and two opposing side edges 33 and 35.

In at least one embodiment, the pillow band 25 is permanently attached to the blanket 12 and pillow 14 (sewn for example), connecting the pillow 14 to the blanket 12. More particularly, pillow band first edge 29 is permanently attached to the blanket first edge 22 (sewn for example). The pillow band 25 is adapted to space the pillow 14 from the blanket 12 for comfort, and allows the pillow 14 to be positionable over the blanket 12. Further at least one of the pillow band length and width is in a predetermined dimensional relationship with at least one of the pillow length and width and/or the blanket length and width. More specifically the pillow length and width is at least one inch greater than pillow band length and width, while the pillow length and width is about one third the blanket length and width respectively.

FIG. 1 depicts pillow 14 is in a generally rectangular or square configuration. The pillow 14 in one embodiment has a length of about 13½ inches and a width of about 21½ inches. Further at least one of the pillow length and width is in a predetermined dimensional relationship with at least one of the pillow band length and width and/or the blanket length and width. More specifically the pillow length and width is at least one inch greater than pillow length and width and the pillow length and width is about one third the blanket length and width respectively.

Pillow 14 has first surface 34 and second surface (not shown) and first edge 36, a second edge 38 and two opposing side edges 42 and 44. In at least one embodiment, at least one or more of the first, second and opposing edges 36, 38, 42 and 44 are attached (sewn together for example) and filled with a non-allergenic material (polyester fiberfill or the like). Further, the pillow first edge 36 is attached to the pillow band second edge 31, where at least one of the pillow first and second surfaces being positionable over the blanket 12.

System 10 further comprises carrying pouch 16 is in a generally rectangular or square configuration. The carrying pouch 16 in one embodiment has a width of about 16 inches and a length of about 19 inches. Further, at least one of the carrying pouch length and width is in a predetermined dimensional relationship with at least one of the pillow length and width, such that the carrying pouch 16 is adapted to receive the blanket 12 when edges 26 and 28 of the blanket 12 are folded over the pillow 14 (so that the blanket is folded in thirds), than the blanket 12 enfolding the pillow 14 is folded again in thirds. More specifically, the predetermined dimensional relationship between the carrying pouch length and width and the blanket length and width comprises the carrying pouch length and width being slightly greater (1 or more inches for example) than pillow length and width respectively.

Carrying pouch 16 has a rectangular first surface or section 46 and a rectangular second surface or section 48 (best viewed in FIGS. 4 and 5), first edge 50, a second edge 52 and two opposing side edges 54 and 56. In at least one embodiment, first and second surfaces 46, 48 are coupled together at least one or more of the first, second and opposing edges 50, 52, 54 and 56. Carrying pouch 16 is stitched around three sides of its periphery 52, 54, 56 but not stitched along the first edge 50 forming an opening. In at least one embodiment, the opening of the carrying pouch 16 is reclosable using releasable fasteners.

When in the carrying mode, this unstitched edge 50 forms the opening for the carrying pouch 16. When in the operational mode for sleeping, carrying pouch 16 is on the second surface 20 of the blanket 12. In at least one embodiment, the carrying pouch 16 communicates with the blanket second edge 24. More specifically, system 10 comprises releasable fasteners along at least the carrying pouch first edge 50.

Figure 2:
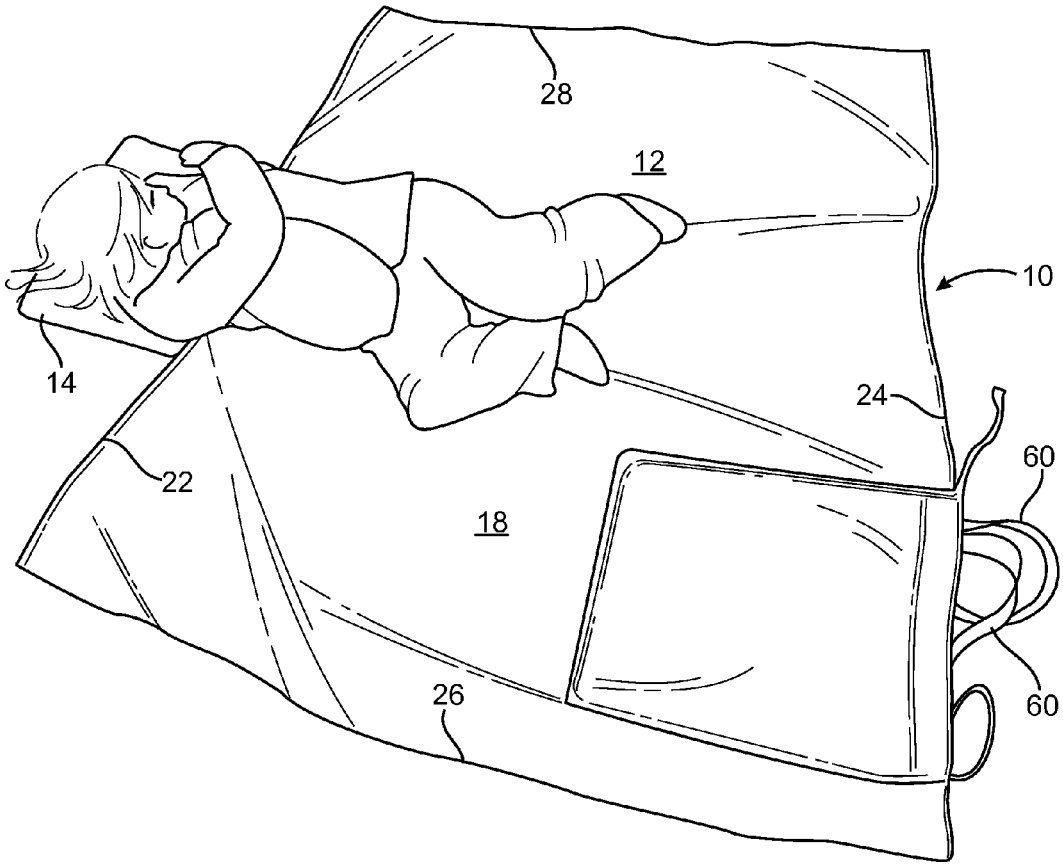
FIG. 2 depicts a user positioned on the wrap system of FIG. 1 depicted in accordance with one embodiment.
Figure 3:
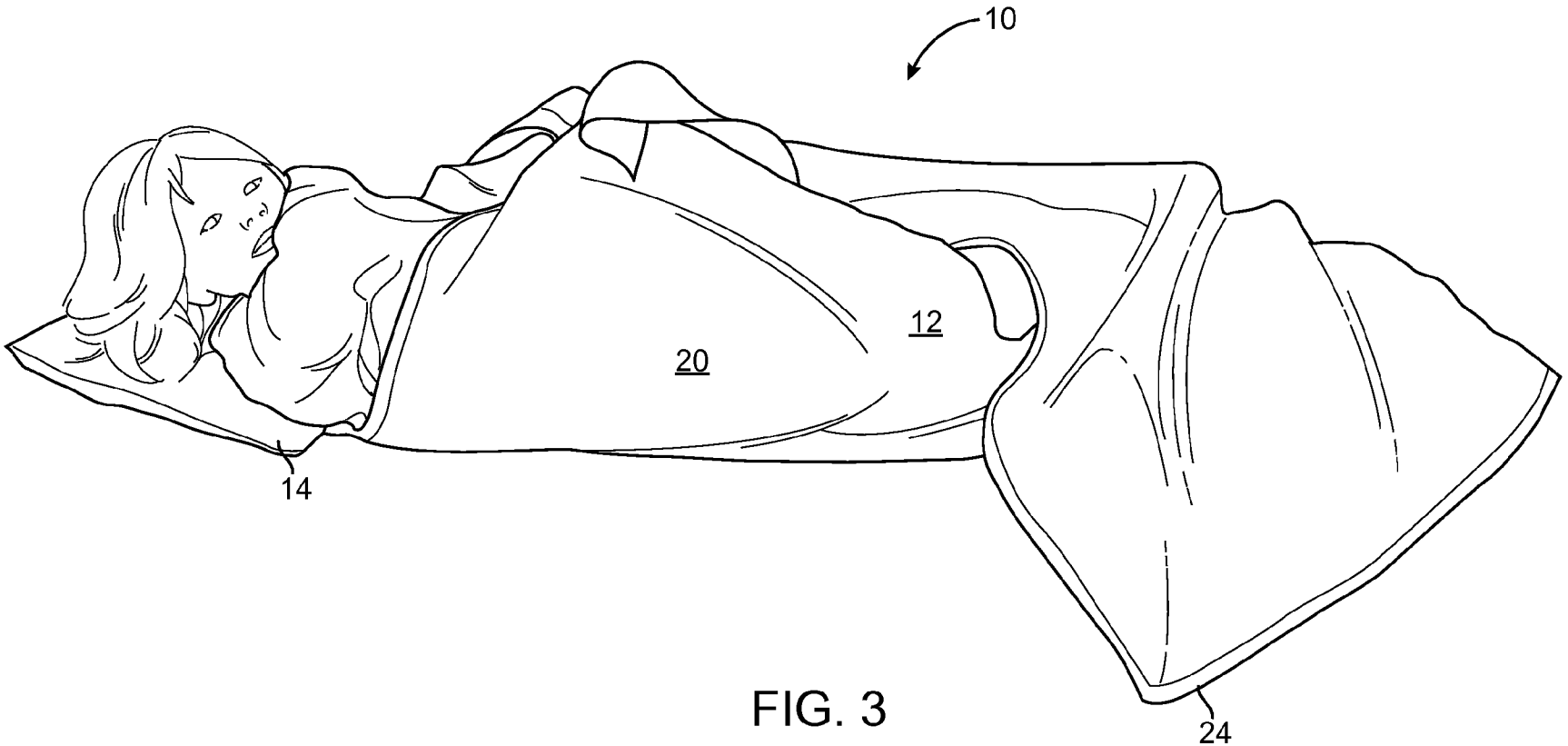
FIG. 3 depicts the user wrapped in the wrap system of FIGS. 1 and 2 in accordance with one embodiment.
Figure 4:
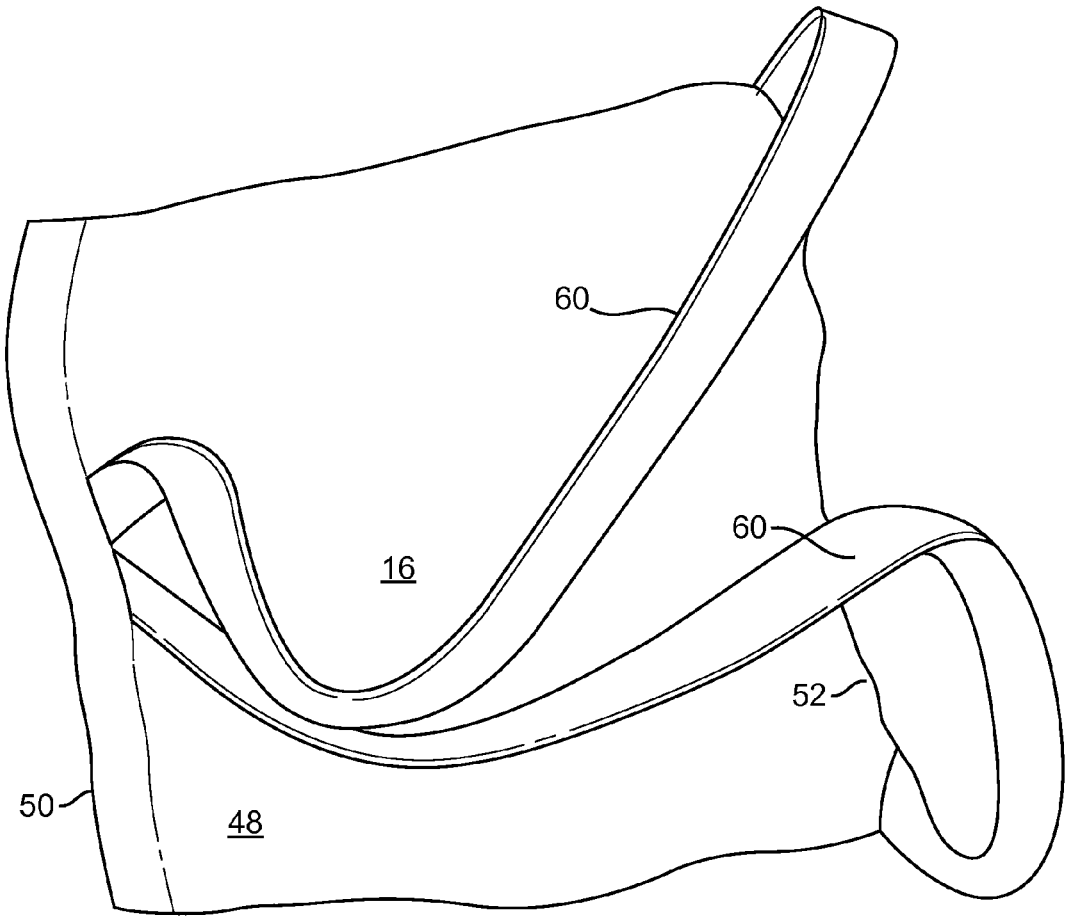
FIG. 4 depicts the blanket and pillow stowed in the carrying pouch positioned in accordance with one embodiment.
Figure 5:
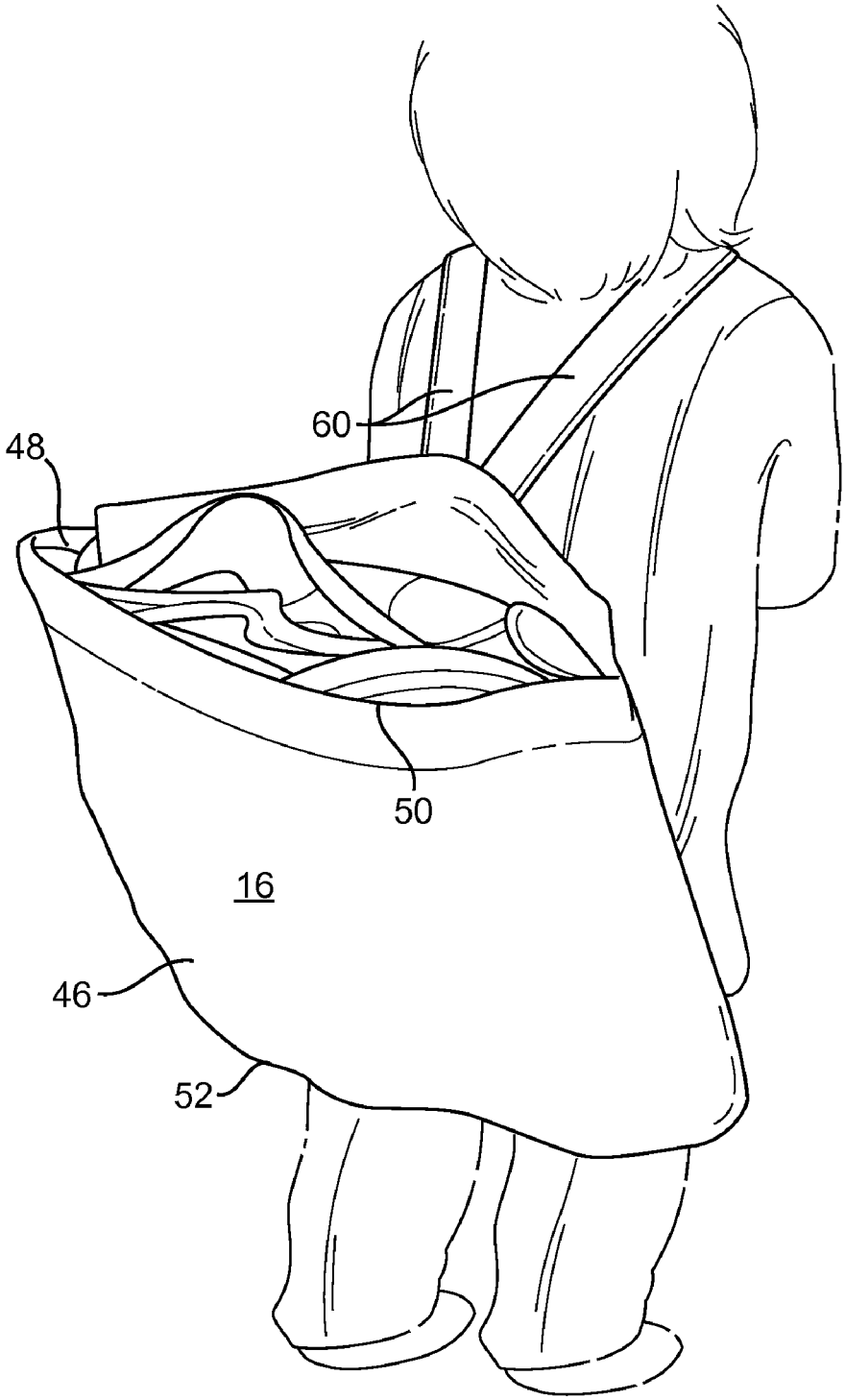
FIG. 5 depicts the carrying pouch of FIG. 4 positioned on the user in accordance with one embodiment.
Figure 6:
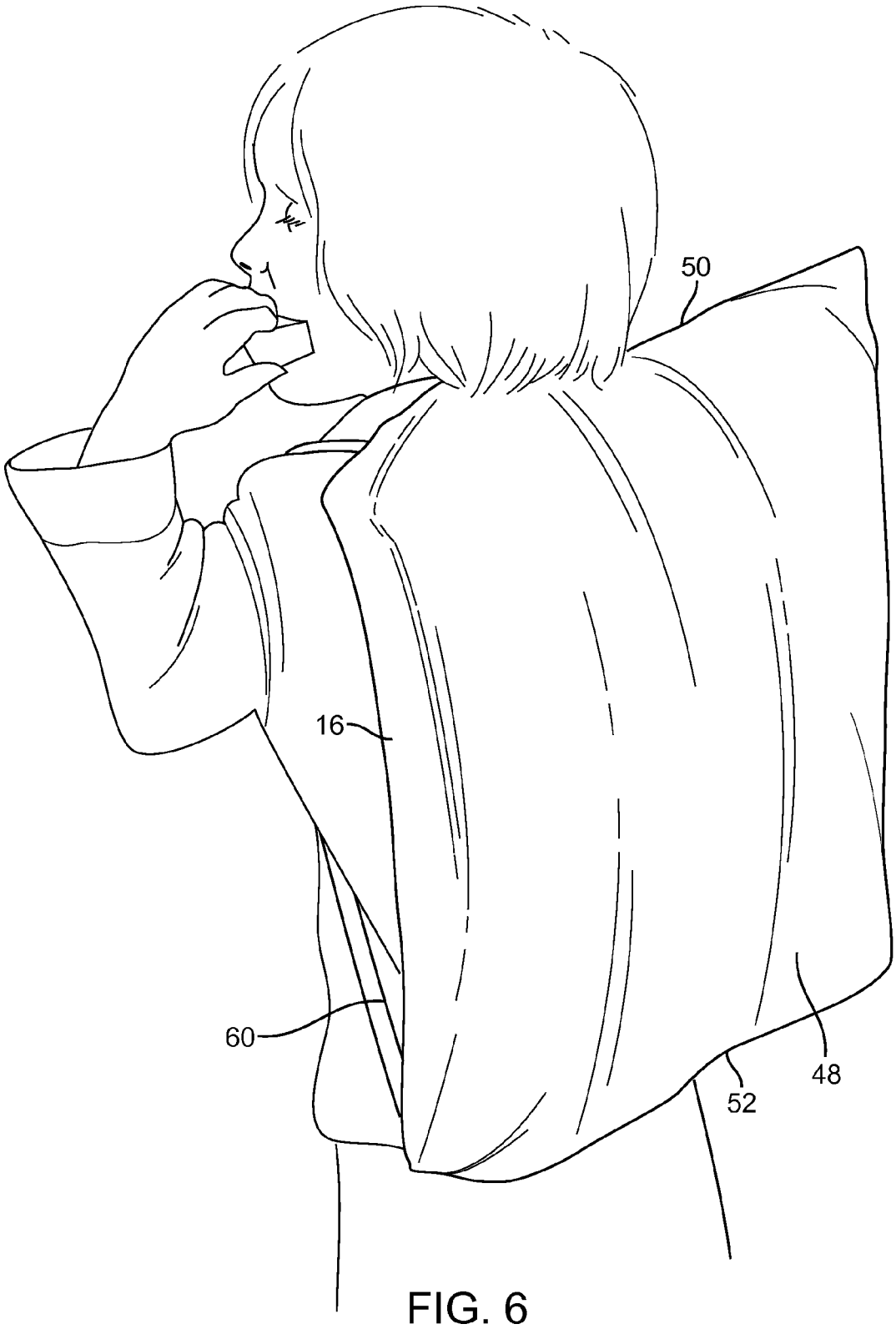
FIG. 6 depicts another embodiment of carrying pouch similar to that of FIG. 4 positioned on the user in accordance with another embodiment.
Figure 7:
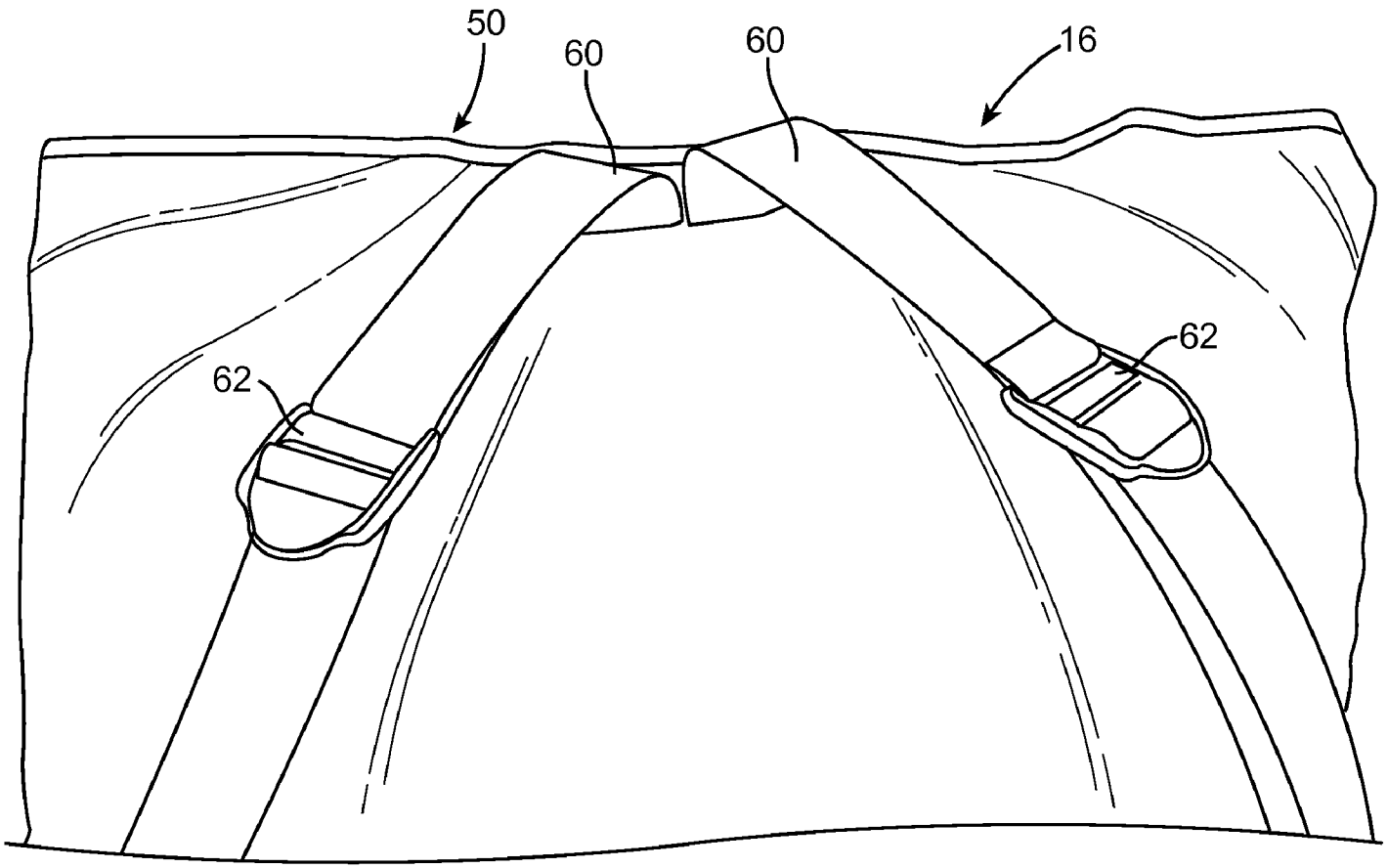
FIG. 7 depicts an enlarged view of the open end of the carrying pouch of FIG. 6 in accordance with another embodiment.

FIGS. 2 and 3 depict a user positioned on the wrap system 10 of FIG. 1 in accordance with one embodiment. FIGS. 4-7 depict embodiments of the carrying pouch 16 having the blanket and pillow stowed therein.

FIGS. 4-7 depict the carrying pouch 16 having two semicircular handles or carrying straps 21½ inches long and extending between top and bottom edges 50 and 52 of the carrying pouch 16. Each handle 60 is made of nylon for example and is adjustable, and in at least one embodiment, has strap adjusters sewn at least one end of each strap 60 (best viewed in FIG. 7). Further, one or more straps may include a releasable fastener. In at least one embodiment, the exterior surface of the carrying pouch is preferably provided with indicia as for personal identification purposes.

An alternate embodiment may include arms and legs of a small animal extending from the sides and bottom with the pillow having a head shape extending upwardly from the upper edge. These additional components to the nap-sac could be permanently secured thereto as by stitching or removably coupling as by removable fasteners such as Velcro® hook and loop fasteners, zippers, buttons or the like.

In an alternate embodiment of the invention, the system 10 is constructed with the entire or partial peripheral edge having additional material hanging down with a resilient elastic thread, band, cord or string at the lower free peripheral edge so that the device can be deployed onto a cot like a fitted sheet.

The blanket 12 is of a size whereby one-third of the left side may be folded over the pillow and center third and one-third of the right side may be folded over the pillow and central third. As a result, when folded laterally, there would be three layers of blanket and pillow to be folded into three sections and placed within the carrying pouch. While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

I claim:

1. A child sleeping system comprising:

a blanket having a generally rectangular configuration and comprising a first and second surface and first, second and two opposing side edges, the blanket having a length and a width;

a pillow band having a generally rectangular configuration and comprising first, second and two opposing side edges, the pillow band first edge communicating with the blanket first edge, the pillow band having a length, width and position, at least one of the pillow band length and width in a predetermined dimensional and positional relationship with at least one of the blanket length and width;

a pillow having a generally rectangular configuration and comprising at least two rectangular portions and first, second and two opposing side edges, the pillow coupled together at least one of the first, second and two opposing edges and filled with a non-allergenic material, the pillow first edge communicating with the pillow band second edge, the pillow having a length, width and position, at least one of the pillow length and width in a predetermined dimensional relationship with at least one of the pillow band length and width and being about one third the blanket length and width respectively and in positional relationship with the blanket length and width; and a carrying pouch having a generally rectangular configuration and comprising at least two rectangular portions and first, second and two opposing side edges, the carrying pouch coupled at the second and two opposing edge defining an opening at the first edge, the carrying pouch communicating with the blanket second edge, the carrying pouch having a length, width and position, at least one of the carrying pouch length and width in a predetermined dimensional and positional relationship with at least one of the pillow length and width and in positional relationship with the blanket, the carrying pouch adapted to receive the blanket and pillow when the pillow is folded over using the pillow band so that one of the pillow two rectangular portions contacts one of the blankets first and second surfaces and one-third of the left side of the blanket and one-third of the right side of the blanket is folded over the pillow and center third, enfolding the pillow, then folded over and into the carrying pouch through the opening at the first end.

2. The system of claim 1 wherein the pillow length and width in predetermined dimensional relationship with at least one of the pillow band length and width further comprises the pillow length and width being about one inch greater than the pillow band length and width respectively.

3. The system of claim 1 wherein the carrying pouch length and width in predetermined dimensional relationship with at least one of the pillow length and width further comprises the carrying pouch length and width being at least one inch greater than the pillow length and width respectively.

4. The system of claim 1 wherein the opening of the carrying pouch is reclosable using releasable fasteners.

5. The system of claim 1 further including a pair of adjustable carrying straps coupled to the carrying pouch.

6. The system of claim 5 wherein each of the pair of adjustable carrying straps includes strap adjusters coupled to at least one end of the carrying straps.

7. The system of claim 5 further including releasable fasteners securing the straps to the carrying pouch.

8. The system of claim 1 further including releasable fasteners along at least one of the two opposing blanket side edges, at least one of the blanket side edges being positionable over another blanket side and closed using the resealable fasteners.

9. The system of claim 1 wherein the carrying pouch has an exterior surface with indicia thereon.

10. A child sleeping system comprising:

a blanket having a generally rectangular configuration and comprising a first and second surface and first, second and two opposing side edges, the blanket having a length and a width;

a pillow band having a generally rectangular configuration and comprising first, second and two opposing side edges, the pillow band first edge communicating with the blanket first edge, the pillow band having a length and width, the pillow band length and width being about one third the blanket length and width respectively;

a pillow having a generally rectangular configuration and comprising at least two rectangular portions and first, second and two opposing side edges, the pillow coupled together at least one of the first, second and two opposing edges and filled with a non-allergenic material, the pillow first edge communicating with the pillow band second edge, the pillow having a length, width and position, the pillow length and width about one inch greater than the pillow band length and width respectively and about one third the blanket length and width respectively, and in positional relationship with the blanket;

a carrying pouch having a generally rectangular configuration and comprising at least two rectangular portions and first, second and two opposing side edges, the carrying pouch coupled at the second and two opposing edge defining an opening at the first edge, the carrying pouch communicating with the blanket second edge, the carrying pouch having a position, and a length and width about one inch greater than the pillow length and width respectively, the carrying pouch adapted to receive the blanket and pillow when the pillow is folded over using the pillow band so that one of the pillow two rectangular portions contacts one of the blankets first and second surfaces, one-third of the left side of the blanket and one-third of the right side of the blanket is folded over the pillow and center third, enfolding the pillow, then folded over and into the carrying pouch through the opening at the first end.

11. The system of claim 10 wherein the opening of the carrying pouch is reclosable using releasable fasteners.

12. The system of claim 10 further including a pair of adjustable carrying straps coupled to the carrying pouch.

13. The system of claim 12 wherein each of the pair of adjustable carrying straps includes strap adjusters coupled to at least one end of the carrying straps.

14. The system of claim 12 further including releasable fasteners securing the straps to the carrying pouch.

15. The system of claim 10 further including releasable fasteners along at least one of the two opposing blanket side edges, at least one of the blanket side edges being positionable over another blanket side and closed using the resealable fasteners.

16. The system of claim 10 wherein the carrying pouch has an exterior surface with indicia thereon.

17. A child sleeping system comprising:

a blanket having a generally rectangular configuration and comprising a first and second surface and first, second and two opposing side edges, the blanket having a length and a width and releasable fasteners along at least one of the two opposing blanket side edges, at least one of the blanket side edges being positionable over another blanket side and closed using the resealable fasteners;

a pillow band having a generally rectangular configuration and comprising first, second and two opposing side edges, the pillow band first edge communicating with the blanket first edge, the pillow band having a length, width and position, at least one of the pillow band length and width in a predetermined dimensional and positional relationship with at least one of the blanket length and width;

a pillow having a generally rectangular configuration and comprising at least two rectangular portions and first, second and two opposing side edges, the pillow coupled together at least one of the first, second and two opposing edges and filled with a non-allergenic material, the pillow first edge communicating with the pillow band second edge, the pillow having a length, width and position, at least one of the pillow length and width in a predetermined dimensional relationship with at least one of the pillow band length and width, and being about one third the blanket length and width respectively, the pillow in positional relationship with the blanket length and width;

a carrying pouch having a generally rectangular configuration and comprising at least two rectangular portions and first, second and two opposing side edges, the carrying pouch coupled at the second and two opposing edge defining an opening at the first edge, the opening having releasable fasteners, the carrying pouch communicating with the blanket second edge, the carrying pouch having a length, width and position, at least one of the carrying pouch length, width and position in a predetermined dimensional relationship with at least one of the pillow length and width, the carrying pouch adapted to receive the blanket and pillow when the pillow is folded over using the pillow band so that one of the pillow two rectangular portions contacts one of the blankets first and second surfaces, one-third of the left side of the blanket and one-third of the right side of the blanket is folded over the pillow and center third, enfolding the pillow, then folded over and into the carrying pouch through the opening at the first end; and a pair of adjustable carrying straps coupled to the carrying pouch using releasable fasteners, each of the pair of adjustable carrying straps includes strap adjusters coupled to at least one end of the carrying straps.

18. The system of claim 17 wherein the carrying pouch has an exterior surface with indicia thereon.

* * * * *